United States Patent [19]

Wilson et al.

[11] 4,162,205

[45] Jul. 24, 1979

[54] METHOD OF ELECTROPLATING TIN AND ALKALINE ELECTROPLATING BATH THEREFOR

[75] Inventors: Harold P. Wilson, Huron, Ohio; Walter C. Bradbury, Townsend, Ga.

[73] Assignee: Vulcan Materials Company, Birmingham, Ala.

[21] Appl. No.: 952,855

[22] Filed: Oct. 19, 1978

[51] Int. Cl.[2] ..... C25D 3/60

[52] U.S. Cl. ..... 204/43 S; 260/447; 260/343.5

[58] Field of Search ..... 204/43 S, 123; 260/447

[56] References Cited

U.S. PATENT DOCUMENTS

| | | | |
|---|---|---|---|
| 3,360,446 | 12/1967 | Jongkind | 204/43 S |
| 3,522,155 | 7/1970 | Dow | 204/43 S |
| 3,663,384 | 5/1972 | Lescure | 204/43 S |

FOREIGN PATENT DOCUMENTS

| | | | |
|---|---|---|---|
| 467145 | 4/1975 | U.S.S.R. | 204/43 S |

*Primary Examiner*—G. L. Kaplan

*Attorney, Agent, or Firm*—Burns, Doane, Swecker & Mathis

[57] ABSTRACT

An improved electrotinplating process and electroplating bath therefor is disclosed. The electroplating bath contains tin ions, an alkali metal hydroxide, and a bismuth compound selected from the group consisting of at least one alkali metal bismuth salt of a linear polyhydroxymonocarboxylic acid having at least six carbon atoms, at least one alkali metal bismuthyl compound of glucono-delta-lactone, and mixtures thereof. The alkali metal bismuth compounds of this invention exhibit increased solubility and long-term stability in hot alkaline alkali metal stannate electroplating baths when compared to conventional alkali metal bismuthates. A preferred alkali metal bismuth compound is an alkali metal bismuthyl gluconate. An improved electrotinplating process is therefore provided which produces a plated tin-bismuth alloy which is resistant to the effects of tin pest.

22 Claims, No Drawings

METHOD OF ELECTROPLATING TIN AND ALKALINE ELECTROPLATING BATH THEREFOR

BACKGROUND OF THE INVENTION

This invention relates to an improvement in the method of producing electrodeposits of tin, and is particularly concerned with a plating bath from which tin deposits can be obtained which are substantially immune to the effects of "tin pest".

It has been found that when materials bearing an electrodeposit of tin are maintained under conditions wherein the ambient temperature is less than 18° C., the transformation of white (beta) tin of tetragonal form to the gray (alpha) tin of cubic centered form occurs. This transformation is commonly knonw as tin "disease" or "tin pest". The result of the transformation is that the specific gravity of the tin or tin electroplate is lowered from about 7.3 to about 5.75 with its attendant destruction of the tin's metallic properties. As the tin pest develops, a loose tin powder is formed which easily separates from the base metal. The tin then loses its ability to protect the base metal. Accordingly, the base metal is more susceptible to the effects of corrosion.

For many years it has been known that a small amount of bismuth in tin or tin electroplate inhibits the formation of the tin pest. It has been reported that a concentration of bismuth above 0.12 percent in tin or tin alloy inhibits and may even prevent the formation of tin pest at temperatures as low as −73° C. for indefinite periods of time. MacIntosh, R. M. "The Properties of Tin at Low Temperatures," Tin Research Institute, Columbus, Ohio (Oct. 15, 1953). In the case of tin electroplate formed by an alkaline process, it is desirable to limit the concentration of bismuth to below 2 percent to avoid the formation of dendrites as well as grainy and very gray tin plates.

In U.S. Pat. No. 3,360,446 bismuth esters (i.e., hydroxy alkyl bismuthates, preferably polyhydroxy alkyl bismuthates) are disclosed for incorporation in alkaline potassium or sodium stannate tin plating baths in a concentration of from 0.05 to 1.5 grams/liter (expressed in terms of the bismuth metal content) to achieve a bismuth content of from 0.1–0.6% in the electrotinplate. Since the alkaline primary reaction mixture containing the bismuthate ester must be neutralized with a weak organic acid immediately to prevent decomposition and the neutralized product must be precipitated with an alcohol several times to be purified, the long term stability of the bismuthate ester in hot alkaline electrotinplating baths may not be very high.

U.S. Pat. No. 3,522,155 discloses the use of alkali metal bismuthates, particularly sodium bismuthates, in alkaline potassium or sodium stannate tin plating baths in a concentration of from 0.05 to 1.0 grams/liter (expressed in terms of the alkali metal bismuthate) for a range of 0.1–0.6% bismuth in the electrotinplate. Laboratory investigations have shown that sodium bismuthate has very low solubility in hot alkaline potassium stannate tin plating baths and tends to hydrolyze and precipitate.

The low solubility of alkali metal bismuthates in alkaline electrotinplating baths normally necessitates the use of a supersaturated solution of the alkali metal bismuthate. Several disadvantages exist with respect to the use of such supersaturated solutions in electrotinplating. Large amounts of the alkali metal bismuthate are required to place the required amount of bismuth into solution. In addition, the quality of the electrotinplate may be affected by suspended alkali metal bismuthate and hydrolyzed bismuth stannate precipitates. Such precipitates would promote sludging in the plating bath since they are autocatalytic to the formation of hydrolyzed stannic hydroxide precipitates. Thus the bath would require purification or replacement more often.

OBJECTS AND SUMMARY OF THE INVENTION

It is an object of this invention to provide an improved process for electrodepositing a tin containing alloy.

It is another object of this invention to provide an improved tin electroplating bath containing an alkaline compound of bismuth which is more soluble than alkali metal bismuthates.

It is yet another object of this invention to provide a tin electroplating bath containing an alkaline compound of bismuth which is stable in hot alkaline alkali metal stannate solutions.

It is still yet another object of this invention to provide a tin electroplating bath containing an alkaline compound of bismuth which more effectively releases bismuth ions within the electroplating bath.

In accordance with one aspect of the present invention, there is provided an aqueous solution for plating tin-containing alloy on a conductive substrate which solution comprises tin ions, alkali metal hydroxide, and a bismuth compound selected from the group consisting of at least one alkali metal bismuth salt of a linear polyhydroxymonocarboxylic acid having at least six carbon atoms, at least one alkali metal bismuthyl compound of glucono-delta-lactone, and mixtures thereof.

In accordance with another aspect of the present invention, there is provided in a method for electroplating a tin-containing alloy onto a conductive substrate comprising immersing a conductive substrate to be plated into an aqueous alkaline plating bath containing tin ions, alkali metal hydroxide, and a bismuth compound, and electroplating a tin-containing alloy onto the substrate as a cathode in the bath, the improvement comprising using as the bismuth compound a compound selected from the group consisting of at least one alkali metal bismuth salt of a linear polyhydroxymonocarboxylic acid having at least six carbon atoms, at least one alkali metal bismuthyl compound of glucono-delta-lacton, and mixtures thereof.

DETAILED DESCRIPTION OF THE INVENTION

It has now been found that an alkali metal bismuth salt of a linear polyhydroxymonocarboxylic acid having at least six carbon atoms and an alkali metal bismuthyl compound of glucono-delta-lactone are each more soluble than previously used alkali metal bismuthates and are also more stable in hot alkaline alkali metal stannate electrotinplating baths. The compounds are also compatible with stannic oxide sol. Useful compounds include sodium bismuthyl gluconate and potassium bismuthyl gluconate. Particularly useful compounds are sodium bismuthyl trigluconate and potassium bismuthyl trigluconate and mixtures thereof, with the latter compound being preferred.

The presence of at least one of the alkali metal bismuth compounds of this invention in the electrotinplating bath supply enough chelating power to increase the solubility of the bismuth in solution.

For example, it has been found that the addition of 0.75 grams/liter of bismuth (in the form of sodium bismuthate) to 500 milliliters of a hot, agitated alkaline tin electroplating bath containing 60 grams/liter of tin and 156 grams/liter of potassium provided only 0.0582 grams/liter of bismuth in solution. Additionally, a large amount of suspended insoluble sodium bismuthate was observed.

In comparison, alkaline solutions of the alkali metal bismuth compounds of this invention dissolve quite readily in alkaline electrotinplating baths and do not form precipitates. In addition, the bismuth compounds of this invention enable substantially greater amounts of bismuth ions to be placed into solution in alkaline electrotinplating baths than has previously been possible. The proper amount of bismuth to inhibit the formation of tin pest is therefore incorporated without difficulty into the electrotinplate when using the improved electrotinplating baths of this invention.

It is believed that linear polyhydroxymonocarboxylic acids having at least six carbon atoms are effective chelating agents for bismuth due to the particular molecular structure of the acids. For example, a polyhydroxymonocarboxylic acid such as gluconic acid will readily form soluble alkaline bismuthyl compounds, while a polyhydroxydicarboxylic acid such as mucic acid will not. In addition, a monocarboxylic acid such as sorbic acid which does not contain any hydroxy substituents is not an effective chelating agent for bismuth. Organic acids having less than six carbon atoms in a linear chain are also ineffective bismuth chelating agents.

Alcohols containing a linear chain of at least six carbon atoms have similarly been found to be effective chelating and solubilizing agents in alkaline bismuth solutions. For example, sorbitol and mannitol are effective solubilizing agents for bismuth, while inositol (a cyclic hexanhexol) will not completely dissolve bismuth in an alkaline solution.

Glucono-delta-lactone also solubilizes bismuth in an alkaline solution to a significant extent. The soluble product (i.e., the alkali metal bismuthyl compound of glucono-delta-lactone) is probably an alkaline bismuth gluconate since glucono-delta-lactone will hydrate to gluconic acid depending upon conditions of pH, temperature, concentration, and time.

The alkali metal bismuthyl gluconates may be formed by dissolving bismuth trioxide in an agitated solution of an alkali metal gluconate containing an excess of alkali metal hydroxide at a temperature in the range of 30°–100° C. or near the boiling point of the solution. Preferably the temperature should be 40°–60° C.

The alkali metal gluconate may be formed in the solution by the addition of gluconic acid to an alkaline solution of an alkali metal hydroxide. For example, bismuth trioxide may be first dissolved in part in an agitated aqueous solution of an alkali metal hydroxide. Gluconic acid may then be added slowly and the solution heated for a period of time to allow the bismuth trioxide to dissolve and the formation of the alkali metal bismuthyl trigluconate to take place. The molar ratio of gluconic acid to bismuth is preferably at least 3:1.

A typical molecular composition in solution is illustrated by the formula:

$$KOH \cdot K_4Bi(OH)_3(gluconate)_3$$

Alkali metal bismuthyl gluconates containing more than three moles of gluconic acid may be formed as long as one mole of the alkali metal hydroxide is added for each additional mole of acid. For example, an alkaline solution of potassium bismuthyl tetragluconate may be prepared and is illustrated by the formula:

$$KOH.K_5Bi(OH)_2(gluconate)_4$$

After completion of the reaction the solution may be dark or black in color and some gray or black residue may be present. This residue is thought to be due to reduction of the bismuth trioxide by the gluconic acid, and the residue may therefore contain bismuth metal as well as suboxides such as bismuthite. To prevent any possible deleterious effect on the quality of tin plate produced from the solution, it is desirable to prevent the formation of such residue. It has been found that the addition of 30 percent hydrogen peroxide solution (technical non-stabilized) in the beginning and throughout the reaction bleaches the color of the reactant solution to a clear red to yellow. The adition of the hydrogen peroxide solution also prevents the formation of residue during the reaction. Oxygen supplied by the hydrogen peroxide apparently counters the reducing power of the gluconate and prevents reduction of bismuth trioxide to bismuth and suboxides of bismuth such as bismuthite.

Other methods of countering the reduction power of the gluconate may be employed in lieu of hydrogen peroxide. Air or oxygen gas, particularly under pressure and dispersed in the reactant solution, would have an effect similar to that exhibited by hydrogen peroxide. Oxygen may be introduced into the solution by vigorous agitation. Alkali metal peroxides may also be utilized. Hydrogen peroxide is preferred, however, because it is an efficient oxidizer and only small amounts are required.

While the addition of an oxidizing agent to the reactant solution during the reaction is desirable, it is not essential. The use of an oxidizing agent depends upon factors such as the amount of residue which normally forms, and the effect which may reduction of the bismuth trioxide may have on the produced tinplate.

The alkali metal bismuth compounds of this invention may also be vacuum dried from solution in order to form dry solids. The vacuum dried solids may be readily dissolved in an aqueous medium to form a alkaline bismuth-containing solution. The vacuum alkali metal bismuth compounds of this invention may therefore be easily stored and transported prior to their incorporation into tin plating baths.

The use of an alkali metal bismuth compound of this invention in a tin electroplating solution presents other advantages besides increased solubility. It has been surprisingly and unexpectedly found that the concentration of bismuth required in solution is less when using an alkali metal bismuth compound of this invention than when other conventional compounds of bismuth are used to achieve the same resultant amount of bismuth in the tin electroplate.

For example, U.S. Pat. No. 3,360,446 discloses that the use of 0.05–1.5 grams/liter of polyhydroxy alkyl bismuthate (expressed in terms of bismuth metal content) in the electroplating solution will provide an electrotinplate containing between 0.1–0.6 percent bismuth. Similarly, U.S. Pat. No. 3,522,155 states that 0.05–1.0 grams/liter of bismuth metal should be present in the electroplating solution as an alkali metal bismuthate to provide an electrotinplate containing 0.1–0.6 percent bismuth.

In accordance with the present invention, however, less bismuth (in the form of the bismuth compounds of the present invention, e.g., an alkali metal salt of the linear polyhydroxymonocarboxylic acid having at least six carbon atoms) need be placed into solution to provide comparable amounts of bismuth within the electrotinplate. For example, in accordance with the present invention, the use of from about 0.0045 to about 0.024 grams/liter of alkali metal bismuthyl trigluconate (expressed in terms of bismuth content) in the electroplating solution yields from about 0.15 to about 0.80 percent bismuth in the electrotinplate.

While not wishing to be bound by the theory behind this unexpected advantage, it is thought that the bismuth ions within the compounds of this invention (e.g., an alkali metal bismuth salt of the polyhydroxymonocarboxylic acid) are much more mobile than the bismuth ions of the conventional bismuth-containing compounds presently used in electroplating solutions. Hence a larger percentage of bismuth ions are available in the solution for the electroplating process when the alkali metal bismuth compounds of this invention are used. Since more of the bismuth ions in solution are available for electroplating, less of the alkaline bismuth compound needs to be placed into solution initially.

Table I shows the dramatic decrease in the amount of bismuth needed in solution when compared to conventional methods to provide acceptable amounts of bismuth within the tin electroplate. The electroplating solution of Table I was formulated by methods consistent with the invention and contained as electroplating compounds potassium stannate and potassium bismuthyl trigluconate.

TABLE I

| % Bismuth to tin | | Concentration of Bismuth in a Solution Containing 8 oz/gal. of Tin and 3 oz./gal. of Free KOH, g.p.l. |
|---|---|---|
| In Tin Plate | In Solution | |
| 0.15 | 0.0075 | 0.0045 |
| 0.20 | 0.010 | 0.0060 |
| 0.25 | 0.013 | 0.0078 |
| 0.30 | 0.015 | 0.0090 |
| 0.40 | 0.020 | 0.0120 |
| 0.50 | 0.025 | 0.0150 |
| 0.60 | 0.030 | 0.0180 |
| 0.80 | 0.040 | 0.0240 |

The dramatic decrease in the amount of bismuth needed in solution to provide an acceptable electrotinplate is clearly demonstrated by the data of Table I when viewed in relation to the bismuth concentrations used in the prior art. For example, U.S. Pat. Nos. 3,360,446 and 3,522,155 state that between 0.05 and 1.0–1.5 grams/liter of bismuth metal should be in solution in order to provide an electrotinplate containing from 0.1–0.6 percent bismuth.

By contrast, Table I shows that when the bismuth compounds of this invention are used to place the bismuth metal in solution, only 0.0045–0.0180 grams/liter of bismuth is required in order to provide an electrotinplate containing from 0.15–0.6 percent bismuth. This result is surprising and clearly advantageous in that it obviates the need to supersaturate the alkaline plating both with bismuth and allows less bismuth to be used initially to place the requisite amount of bismuth ions into solution.

The process of electroplating the tin-bismuth alloy onto a conductive substrate may be carried out in a conventional manner. For example, the conductive substrate may be a metal such as iron, nickel, stainless steel, zinc, copper, etc., or a combination of two or more of any such metals. Electrodeposition may be effected using either a soluble or insoluble anode. Insoluble anodes typically are comprised of steel, while soluble anodes may be comprised of tin metal or a tin alloy. Electrodeposition of the tin-containing alloy usually occurs at a temperature within the range of 60° C. to about the boiling point of the solution, e.g., about 105° C. Cathode current densities of about 1 a.s.d. to about 40 a.s.d. are generally employed.

Electrodeposition of a tin-containing alloy in accordance with this invention is effected by maintaining the conductive substrate as a cathode within the aqueous electroplating baths of this invention for 1–60 minutes or as long as necessary for the electroplate thickness desired. The electrodeposition of the tin-containing alloy for a period of time within this range will result in an electrotinplate containing from about 0.15–0.80 percent bismuth, expressed as bismuth metal.

Described below in Table II are compositions of electrolyte solutions formulated from a source of tin ions, alkali metal hydroxides, and an alkali metal bismuthyl trigluconate in accordance with this invention which give good performance in electroplating tin-bismuth alloys on substrates.

TABLE II

| Component | Concentrations (grams/liter) Broad | Preferred | Typical |
|---|---|---|---|
| tin metal | 15–75 | 38–60 | 40 |
| Alkali metal hydroxide | 8–60 | 15–45 | 15 |
| Alkali metal bismuthyl trigluconate | 0.001–0.15 | 0.014–0.122 | 0.026 |

An alkali metal stannate and stannic oxide sol are both examples of a source of tin metal ions which may be used within the electroplating baths of this invention.

Concentrations of the preferred components of the electroplating baths are as follows:

TABLE III

| Component | Concentrations (grams/liter) Broad | Preferred | Typical |
|---|---|---|---|
| Potassium Stannate | 39–195 | 99–156 | 104 |
| Potassium hydroxide | 8–60 | 15–45 | 15 |
| Potassium bismuthyl trigluconate | 0.001–0.15 | 0.014–0.122 | 0.026 |

This invention is additionally illustrated in connection with the following Examples which are to be considered as illustrative of the present invention. It should be understood, however, that the invention is not limited to the specific details of the Examples.

EXAMPLE 1

This example demonstrates a method for producing potassium bismuthyl trigluconate in an alkaline solution and its use in an electrotinplating process.

1A. A Method of Producing Potassium Bismuthyl Trigluconate Using Gluconic Acid

A weight of 55.8 grams of yellow bismuth trioxide containing 50.0 grams of bismuth is agitated vigorously in a solution of 67.2 grams of potassium hydroxide pellets in 100 milliliters of distilled water. Then 1.50 milliliters of non-stabilized technical grade 30% hydrogen peroxide is added to the slurry. The temperature of the slurry rises to 68° C. as 228 milliliters of 50% gluconic acid are added slowly. An additional milliliter of 30% hydrogen peroxide is added to bleach a pea green color that develops to a bright orange color. Then the agitated slurry at 60° C. is heated to maintain the temperature at an average of 63° C. in a range of 57° C.–65° C. for two hours until all of the bismuth trioxide is dissolved. During this period 1.55 milliliters of the 30% hydrogen peroxide are added in small increments.

The product of the reaction is 300 ml. of clear dark red solution having a density of 1.482 grams/milliliter at 24.0° C. and by chemical analysis contains 178.9 grams per liter of bismuth.

1B. A Method of Producing Soluble Potassium Bismuthyl Compounds Using Glucono-delta-lactone A slurry of approximately 140 grams/liter of $Bi_2O_3$ in a distilled water solution of 168 grams/liter of potassium hydroxide is agitated for 77 minutes with the temperature being in the range of 40°–44° C. Then 320 grams/liter of glucono-delta-lactone are added and agitation continued for four hours and 16 minutes at a temperature of 44°–80° C. During the agitation period hydrogen peroxide (30–35%, nonstabilized) is added in small increments for a total dosage of 0.65 milliliters/gram of bismuth to counteract the reducing power of the lactone. Occasionally a little distilled water is sprayed on the inner walls of the beaker to wash down a little $Bi_2O_3$. The $Bi_2O_3$ progressively dissolves. Then 17.3 grams/liter of potassium hydroxide and 57.3 grams/liter of glucono-delta-lactone, equivalent to an additional mole in ratio to a mole of bismuth, are added for good measure and the agitation and heating at 63° C. are continued for another 46 minutes for a total reaction time of six hours and 19 minutes. A clear amber solution with a little residue is obtained. Analysis of the product solution gives 66 grams/liter of soluble bismuth which is equivalent to 99.0% of the bismuth input as bismuth trioxide. The final formulation is equivalent to $KOH.K_5Bi(OH)_2$ (glucono-delta-lactone)$_4$, but it is strongly suspected that the ligand is actually a gluconate (3–4 moles) derived from the hydration of glucono-delta-lactone.

1C. Electrotinplating With A Plating Bath Containing Potassium Bismuthyl Trigluconate A liter plating bath is formulated with Vulcan potassium stannate and potassium hydroxide pellets to provide 8 oz./gal. tin and 3 oz./gal/free KOH. The bath is fitted with Type 316 stainless steel anodes and heated to temperatures in the range of 80° C. to 84° C. About 0.2 mil of tin is electroplated at a current density of 14.7 amperes/ft$^2$ on an acid etched steel panel as a control. Then 0.4 milliliter of alkaline potassium bismuthyl trigluconate solution by analysis containing 49.0 grams/liter of bismuth is added to the bath for 0.0196 grams/liter of bismuth. There is a slight tinting of the solution but no precipitation. Then six more steel panels are electroplated with 0.2 mil of tin at a current density of 14.7 amperes/ft.$^2$. The tin plates containing bismuth show no change in appearance from that of the control panel. The last tin plate in the series and the solution are analyzed. The tin plate contains 0.29% bismuth. The solution has 57.26 grams/liter of tin and 0.0162 grams/liter of bismuth or 0.028% bismuth to tin. The solution remains clear throughout the electrotinplating.

The next-to-last tin plate panel in the series contains approximately the same amount of bismuth as the tin plate which was analyzed and is placed in a cold box at temperatures near −40° C. for three weeks with a control tin plate panel without additives. In one day the control tin plate disintegrates and blasts off the steel panel. At the end of the three-week period, the tin plate containing bismuth remains unchanged and shows no signs of "tin pest".

EXAMPLE 2

A clear dark red alkaline solution of sodium bismuthyl trigluconate containing 94 grams per liter of bismuth is prepared from bismuth trioxide in the same manner as the Example 1A reaction for potassium bismuthyl trigluconate. In this case two additional moles of sodium hydroxide per mole of bismuth are added to dissolve the last bit of bismuth trioxide and the final temperature is 82° C. The molecular composition of the compound formed is illustrated by the formula:

$$3NaOH.Na_4Bi(OH)_3\ (gluconate)_3$$

The sodium bismuthyl trigluconate compound is employed in an electrotinplating bath as described in Example 1B. The electroplating process produces electrotinplate similarly resistant to tin "pest".

EXAMPLE 3

Yellow bismuth trioxide in an amount of 5.6 grams and containing 5.0 grams of bismuth is agitated strongly in a solution of 6.7 grams of potassium hydroxide in 50 milliliters of distilled water. A weight of 13.1 grams of sorbitol is dissolved in the solution to provide a sorbitol:bismuth molar ratio of 3:1. The solution is heated and the temperature rises from 26° C. to 68° C. in 12 minutes. For the remainder of the total reaction time of 2.5 hours, the temperature is maintained at an average of 68° C. in the range of 60° C. to 72° C. During the reaction 2.5 milliliters of hydrogen peroxide (30%, nonstabilized) is added in small increments. There is some evaporation and the product constitutes about 30 milliliters of clear amber solution which contains 161.0 grams of bismuth/liter by analysis indicating that the bismuth had almost completely dissolved. The molecular composition of the product is characterized by the formula:

$$KOH.K_4Bi(OH)_6\ (Sorbitol)_3$$

Under the same conditions D-mannitol was similarly effective to dissolve bismuth trioxide while inositol dissolved substantially less bismuth trioxide than either sorbitol or D-mannitol.

The principles, preferred embodiments, and modes of operation of the present invention have been described in the foregoing specification. The invention which is intended to be protected herein, however, is not to be construed or limited to the particular forms disclosed, since these are to be regarded as illustrative rather than restrictive. Variations and changes may be made by those skilled in the art without departing from the spirit of the invention.

I claim:

1. In a method for electroplating a tin-containing alloy onto a conductive substrate comprising immersing a conductive substrate to be plated into an aqueous alkaline plating bath containing tin ions, alkali metal hydroxide, and a bismuth compound, and electroplating a tin-containing alloy onto the substrate as a cathode in the bath, the improvement comprising using as the bismuth compound a compound selected from the group consisting of at least one alkali metal bismuth salt of a linear polyhydroxymonocarboxylic acid having at least six carbon atoms, at least one alkali metal bismuthyl compound of glucono-delta-lactone, and mixtures thereof.

2. The method of claim 1 wherein the bismuth compound is an alkali metal bismuthyl gluconate.

3. The method of claim 2 wherein the alkali metal bismuthyl gluconate is selected from the group consisting of potassium bismuthyl trigluconate, sodium bismuthyl trigluconate and mixtures thereof.

4. The method of claim 3 wherein the alkali metal bismuthyl gluconate is potassium bismuthyl trigluconate.

5. The method of claim 3 wherein the alkali metal bismuthyl gluconate is sodium bismuthyl trigluconate.

6. The method of claim 2 wherein the aqueous alkaline plating bath contains 0.001–0.15 grams/liter of bismuth metal as alkali metal bismuthyl gluconate.

7. The method of claim 1 wherein tin ions are provided by an alkali metal stannate.

8. The method of claim 7 wherein said alkali metal stannate is potassium stannate.

9. The method of claim 1 wherein said tin ions are provided by a stannic oxide sol.

10. A method of electroplating a tin-containing alloy onto a conductive substrate comprising immersing a conductive substrate to be plated into an aqueous alkaline plating bath containing potassium stannate and potassium bismuthyl trigluconate, and electroplating a tin-containing alloy onto the substrate as a cathode in the bath.

11. A method of electroplating a tin-containing alloy onto a conductive substrate comprising immersing a conductive substrate to be plated into an aqueous alkaline plating bath containing a stannic oxide sol and potassium bismuthyl trigluconate, and electroplating a tin-containing alloy onto the substrate as a cathode in the bath.

12. An aqueous solution for plating a tin-containing alloy on a conductive substrate which solution comprises tin ions, alkali metal hydroxide, and a compound selected from the group consisting of at least one alkali metal bismuth salt of a linear polyhydroxymonocarboxylic acid having at least six carbon atoms, at least one alkali metal bismuthyl compound of glucono-delta-lactone, and mixtures thereof.

13. The aqueous solution of claim 12 wherein said alkali metal bismuth salt is an alkali metal bismuthyl gluconate.

14. The aqueous solution of claim 13 wherein said alkali metal bismuthyl gluconate is selected from the group consisting of potassium bismuthyl trigluconate, sodium bismuthyl trigluconate and mixtures thereof.

15. The aqueous solution of claim 14 wherein said alkali metal bismuthyl gluconate is potassium bismuthyl trigluconate.

16. The aqueous solution of claim 14 wherein the alkali metal bismuthyl gluconate is sodium bismuthyl trigluconate.

17. The aqueous solution of claim 13 which comprises from 0.001–0.15 grams/liter of bismuth metal as alkali metal bismuthyl gluconate.

18. The aqueous solution of claim 12 wherein said tin ions are provided by an alkali metal stannate.

19. The aqueous solution of claim 18 wherein said alkali metal stannate is potassium stannate.

20. The aqueous solution of claim 12 wherein said tin ions are provided by a stannic oxide sol.

21. An aqueous solution for plating a tin-containing alloy on a conductive substrate which solution comprises potassium stannate and potassium bismuthyl trigluconate.

22. An aqueous solution for plating a tin-containing alloy on a conductive substrate which solution comprises a stannic oxide sol and potassium bismuthyl trigluconate.

* * * * *